United States Patent [19]

Pfeiffer

[11] Patent Number: 4,662,637

[45] Date of Patent: May 5, 1987

[54] METHOD OF PLAYING A CARD SELECTION GAME

[75] Inventor: Arthur M. Pfeiffer, Palo Alto, Calif.

[73] Assignee: Churkendoose, Incorporated, Palo Alto, Calif.

[21] Appl. No.: 761,967

[22] Filed: Aug. 2, 1985

Related U.S. Application Data

[63] Continuation-in-part of Ser. No. 759,654, Jul. 25, 1985.

[51] Int. Cl.[4] ..... A63F 1/14

[52] U.S. Cl. ..... 273/149 P; 221/265

[58] Field of Search ..... 273/149 P, 149 R, 85 CP, 273/138 A; 221/224, 225, 233, 265

[56] References Cited

U.S. PATENT DOCUMENTS

| | | | |
|---|---|---|---|
| 3,770,269 | 11/1973 | Elder | 273/138 A |
| 3,889,956 | 6/1975 | Castle | 273/138 A |
| 4,033,590 | 7/1977 | Pic | 273/149 R |
| 4,052,057 | 10/1977 | Castle | 273/1 E |
| 4,093,215 | 6/1978 | Ballard | 273/1 E |
| 4,099,810 | 7/1978 | Stange | 312/183 |
| 4,145,038 | 3/1979 | Mol | 270/58 |
| 4,250,028 | 2/1981 | Talyzin et al. | 209/583 |
| 4,358,016 | 11/1982 | Richardson et al. | 209/564 |
| 4,373,185 | 2/1983 | Mills et al. | 364/478 |
| 4,380,334 | 4/1983 | Minkoff et al. | 273/85 CP |
| 4,497,488 | 2/1985 | Plevyak et al. | 273/149 R |
| 4,534,562 | 8/1985 | Cuff et al. | 273/149 R |

*Primary Examiner*—Anton O. Oechsle
*Assistant Examiner*—MaryAnn Stoll Lastova

[57] ABSTRACT

A method of playing a card game in which desired cards are selected by players. Cards are first read and stored. Players select cards and then cards corresponding to the selected cards are delivered to each player. Selecting and delivering of cards is repeated until each player has a predetermined number of cards. The outcome of the game is then determined. Each card is marked with machine readable indicia so that players may receive cards corresponding to their selection. Null cards having no value in determining the outcome may be used and are deliverd when players select the same card, select a card previously dealt or delivered, or do not select within a time limit. Poker rules may be used to determine the outcome.

10 Claims, 11 Drawing Figures

METHOD OF PLAYING A CARD SELECTION GAME

CROSS REFERENCE TO RELATED APPLICATION.

This application is a continuation-in-part of prior application Ser. No. 759,654 filed July 25, 1985, assigned to the assignee of the present invention.

DESCRIPTION

1. Technical Field

The present invention relates to card games.

2. Background Art

Card games generally rely on a combination of skill and chance for their popularity. The most popular games, such as bridge, poker, rummy, and pinochle, all require a certain amount of skill to win, whereas those games which require less skill and more luck have either been forgotten, relegated to children or survive with some degree of popularity only in gambling houses.

The game of poker is well known and the rules can be found in nearly every card game rule book. In the game of poker cards are dealt to each player. Players may have a chance to improve their hand by discarding some of their cards, and receiving replacements, as in draw poker, or more cards may be dealt than needed and the best cards retained, as in the seven-card variations of poker. Various rounds of betting take place after dealing and after drawing. In stud poker, one card is dealt face down and the four remaining cards are dealt face up one at a time with a round of betting after each face up card is dealt. In all variations of poker, when the betting rounds are completed, the remaining players expose their hands and the winning player collects the money bet. The outcome is determined by the combinations of cards in the exposed hands. Those combinations are well known as high card, one pair, two pair, three-of-a-kind, straight, flush, full house, four-of-a-kind, and straight flush, and are described in nearly every card game rule book.

Unfortunately, in poker good combinations such as straight flush, four-of-a-kind and full house are rare. Most people are reluctant to bet much when they hold only one or two pair. As a result too many people drop out of the betting early, which may frustrate even people with good hands. One common solution is to introduce wild cards to increase the chances of receiving a good hand and thus keep the game interesting, but even getting a wild card involves more luck than skill.

In the children's card game called "fish", a certain number of cards is dealt to the players. Each player in turn asks another player for cards of a value or rank which he holds in his hand. If the other player does not have any cards of that value, the asking player draws a card from the remaining deck. Each player tries to collect all of the cards of a rank to form a group. The player with the most groups at the end of the game wins. This children's game offers more strategy than many children's games and is thus very popular.

An object of the invention is to provide card games such as poker with a greater amount of strategy and skill in order to make them more entertaining.

DISCLOSURE OF THE INVENTION

The above object has been met with a method for playing a card game in which desired cards are selected by the players. Each card is marked with machine readable indicia so that players may receive cards which correspond to their selection. The method involves first reading and storing a deck of such cards. Players select cards and then cards, corresponding to the cards selected, are delivered to the players. Selecting and delivering of cards is repeated until each player has a predetermined number of cards in his hand. The outcome of the game is then determined.

One such game is the card game called "Pickem". In "Pickem", a deck of 52 playing cards plus 49 or more "null cards" are used. Null cards are cards having no value in determining the outcome of a card game. Both playing and null cards must be identification marked so that cards may be machine read and stored. Two to eight players may play. Rules are similar to poker rules. Unlike poker, however, players receive cards by their own selection. At each round, each player selects a card and cards selected or a null card are delivered, depending on the circumstances. Null cards are special cards that have no value. There may be a time limit for selecting a card. Players not completing a selection before time runs out receive a null card. If more than one player selects the same card, each of them receives a null card. If a player selects a card dealt or delivered to someone in a previous round, then a null card is received. In lieu of null cards, the game may be played with randomly chosen cards given instead of null cards.

Card selection games such as "Pickem" are more entertaining than games relying on luck because strategy is needed in selecting cards. Better combinations result in more active rounds. In order to facilitate game playing, particularly card selection, a card reading, storing and dealing apparatus is provided.

BEST MODE FOR CARYYING OUT THE INVENTION

The card games disclosed herein can best be played with the card reading, storing and dealing apparatus described below. While this apparatus is preferred, it is not the sole apparatus for playing the games.

Figure 1:
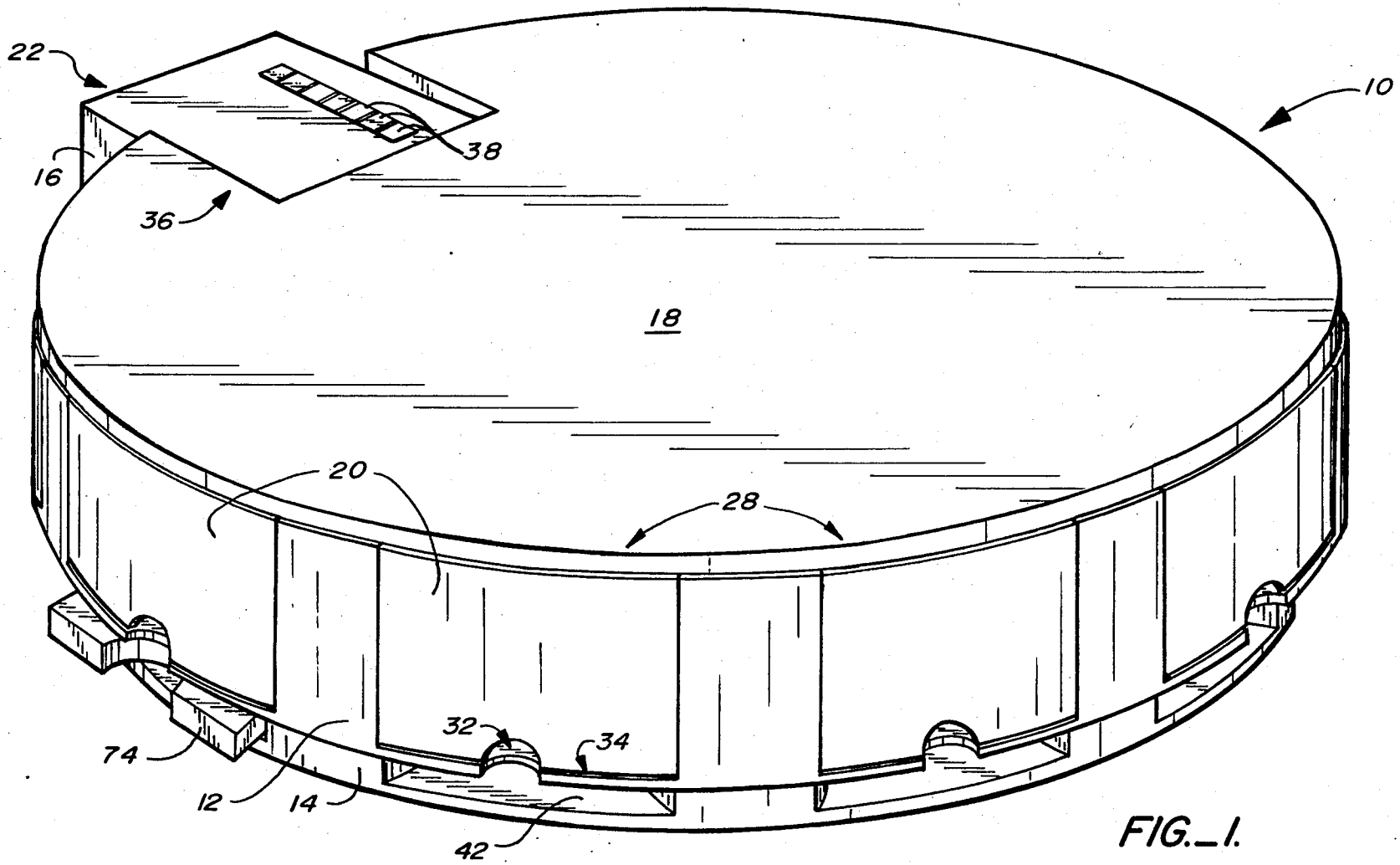
FIG. 1 is a perspective view of the apparatus of the present invention.

With reference to FIG. 1, a card game apparatus 10 has a frame 12 seated on a molded base 14. Typical dimensions for apparatus 10 are a diameter of about 18 inches (46 cm) and a height of about 4 inches (10 cm). A carousel cover 18 seated on top of the apparatus 10, and a plurality of hinged output doors 20 close the top and side wall sections of frame 12. They are liftable for access to the working parts in the interior of apparatus 10. Preferably, the frame is made of molded plastic, combining durability and light weight, but other materials may also be used.

A plurality of user stations 28 are distributed around the apparatus. Each user station 28 has an output port where cards are delivered face down. Dealt cards are removed from an output port through a slit 34 under hinged output door 20. A finger notch 32 formed in base 14 and door 20 at each user station 28 permits player access to dealt cards in the output port without having to lift door 20.

The apparatus has selector recesses 42 adapted for receiving selectors 74 indicating a user's card selection. Recesses 42 are typically positioned at each player position 28 in molded base 14 beneath the corresponding output port. Selector dials, slides or buttons on the selector may be provided to make the card selection. Once inserted the selector makes contact through a connector to register the desired selection. Alternatively, selectors may communicate card selections to the apparatus 10 via wired connection or infrared beams.

Typically, the selector displays the selection through a small window, thus keeping the information private. A window on the selector displaying public information for others to see may also be included. Once the selector is inserted into a recess the private windows are covered while the public windows may be exposed.

Figure 2:
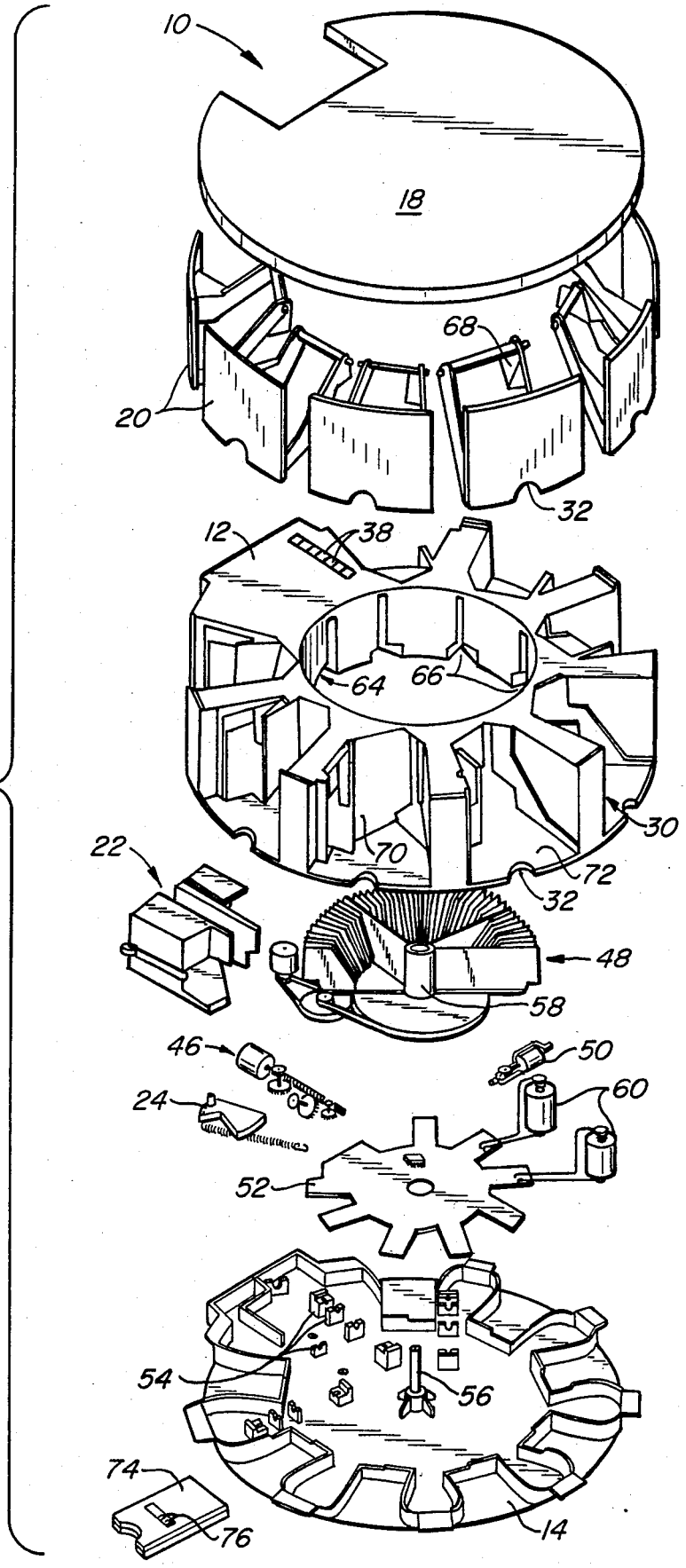
FIG. 2 is an exploded perspective view of the apparatus of FIG. 1.

With reference to FIG. 2, the interior of apparatus 10 can be seen to comprise an injector 46, a hopper 22, a carousel 48, an ejector 50 for each output port 30, and a control board 52. The output ports 30 are part of frame 12. Injector 46 and ejectors 50 are mounted on supports 54 molded into base 14. Hub pin 56, projecting from the center of molded base 14, turnably supports carousel 48 at a hub 58.

A card input hopper 22 mounted in frame 12 can hold at least 104 cards which are within a specified size range. Typically, this range includes standard poker and bridge playing cards. A spring-loaded lever 24 holds the cards flat against a side wall 26 of the hopper 22. One or more decks of playing cards are loaded into hopper 22. The hopper 22 may be top loaded or side loaded. For top loading, the lever is manually retracted. For side loading, the insertion of the cards may retract the lever. The cards are then fed one at a time into apparatus 10.

Cards loaded into card hopper 22 are fed by injector 46 through an opening 64 in back of hopper 22 into carousel 48. Cards are delivered to appropriate output ports 30 by their corresponding ejectors 50. Cards ejected from carousel 48 pass through openings 66 in back of the output ports 30 into the output ports 30. Projection 68 at each output port 30 contacts the top edge of an incoming card, causing it to rotate and thus fall flat onto the floor 72 of output port 30. The port's rear wall 70 is angled to bring the card to the front of the port 30 while it falls. Cards are then removed from output port 30 through slit 34 or by lifting door 20.

Injector 46, carousel 48 and ejectors 50 are motor driven and powered by batteries 60. Each battery is situated in an output port 30 behind door 20. Batteries 60 also provide electric power to control board 52. Typically, four or more D size 1.5 volt batteries provide sufficient power to operate apparatus 10. An external connector is provided for alternate power sources.

Selectors, such as selector 74, are used to indicate an active user station and to select cards in those card games where the players request specific cards. Each selector 74, which is about the size of a stack of 30 cards can be set with dials 76 to one of a number of settings for the desired communication and inserted into recess 42 which incorporates a connector. A standard computer interface may also be included via extra pins in one of the selector recesses 42. Alternatively, selector 74 may be set with buttons or slides. Several user control buttons such as pass, deal, etc. may be included on selector 74 or at each user station 28. Also, communication between selectors 74 and control board 52 may be by wires or infrared beams.

Figure 3:
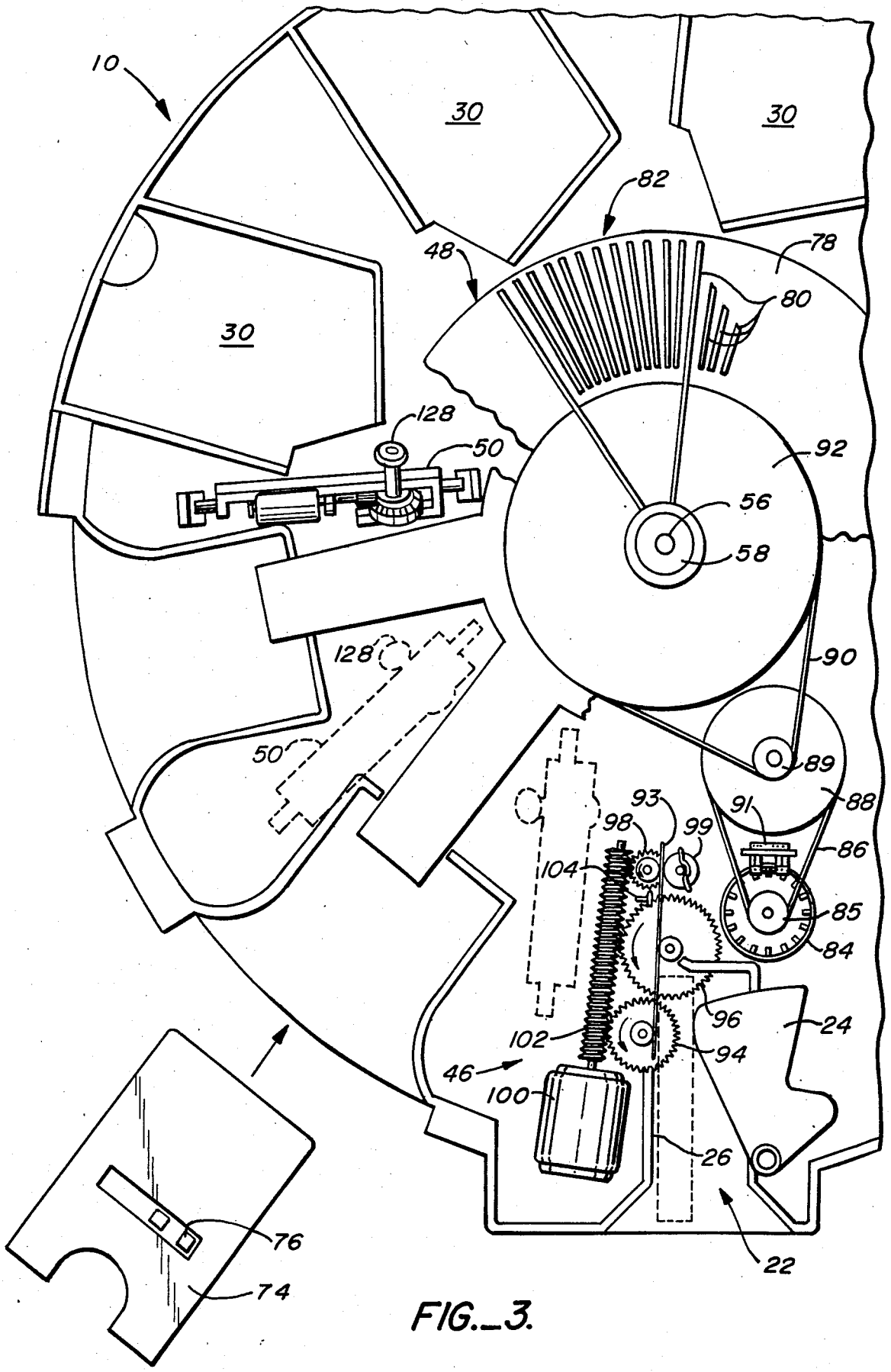
FIG. 3 is a top cutaway view of the apparatus of FIG. 1.
Figure 4:
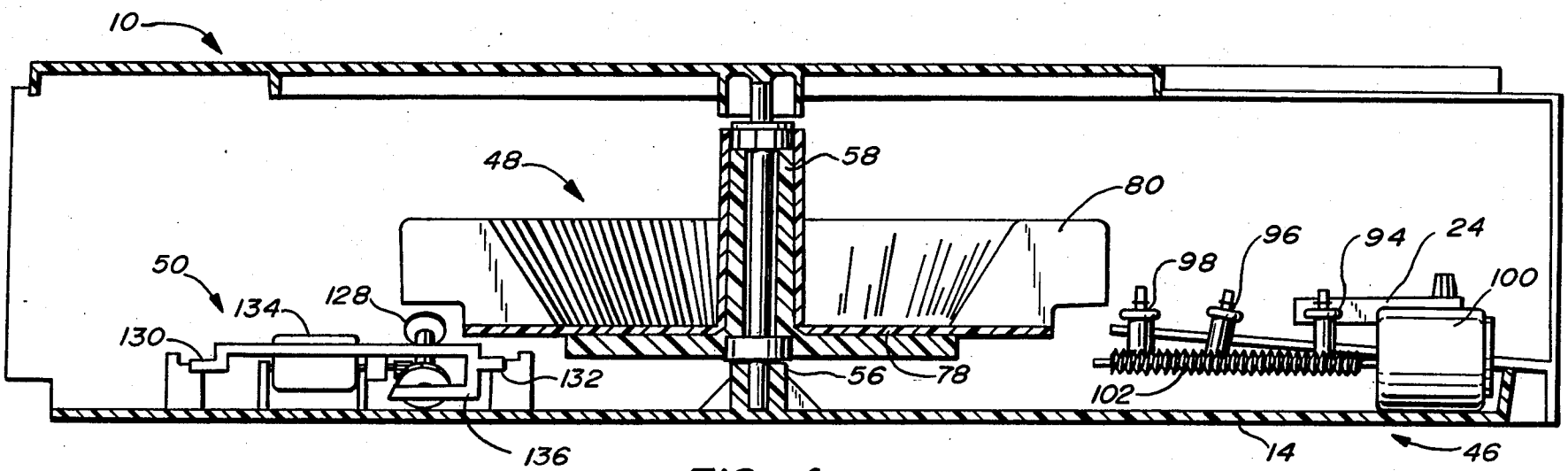
FIG. 4 is a side cutaway view of the apparatus of FIG. 1.
Figure 5:
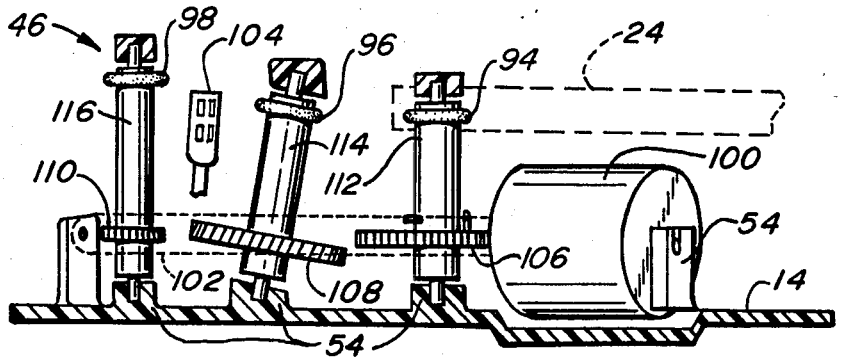
FIG. 5 is a side view of the injector mechanism used in the apparatus of FIG. 1.

With reference to FIGS. 3 and 4, injector 46 loads cards 93 one at a time from card hopper 22 into slots 82 of carousel 48. Injector 46 preferably has three driven rollers 94, 96 and 98 which are driven by an injector motor 100 via a worm gear 102. Injector 46, seen in greater detail in FIG. 5, sits on molded base 14 supported by supports 54. Each roller 94, 96 and 98 is a small, preferably rubberized, wheel on shafts 112, 114 and 116 having gears 106, 108 and 110 respectively. Gears 106, 108 and 110 each engage worm gear 102 driven by motor 100. Typically, third gear 110 is about one-third as small as first and second gears 106 and 108.

Spring loaded lever 24 holds a deck of cards firmly against first roller 94. In FIG. 3, first roller 94 turns in a direction such that card 93 is driven toward carousel 48. The second roller 96 turns in the same direction as first roller 94, but cards contact the opposite side of second roller 96 from first roller 94, so all but the first card are pushed back into the hopper. Second roller 96 is preferably spaced so that it firmly contacts the second card to drive it back, but does not contact the first card 93 which continues toward carousel 48. Third roller 98 drives card 93 into an empty slot 82 of carousel 48.

The second and third rollers may be spring loaded against the card or a spring loaded idler wheel such as 99 may be used to insure contact. Alternatively, a recess may be provided into which the card must be deflected by the roller in order to pass. Since cards have some rigidity they act effectively as a spring, insuring contacte with the rollers.

The hopper 22 is tilted upward toward the carousel at between zero and fifteen degrees. This prevents interference with cards in adjacent slots 82 in carousel 48. However, the first and third rollers 94 and 98 are mounted with their axes perpendicular to the base 14 and so are angled between zero and fifteen degrees relative to the hopper 22. The second roller 96 is angled between zero and fifteen degrees relative to the hopper 22 but in the opposite direction. Thus its axis is between zero and thirty degrees relative to the base of 14. As the three rollers turn, the cards are thus driven down to the floor of hopper 22. This keeps the card loaded against the bottom of hopper 22 and thus in alignment with scanner 104.

Figure 6:
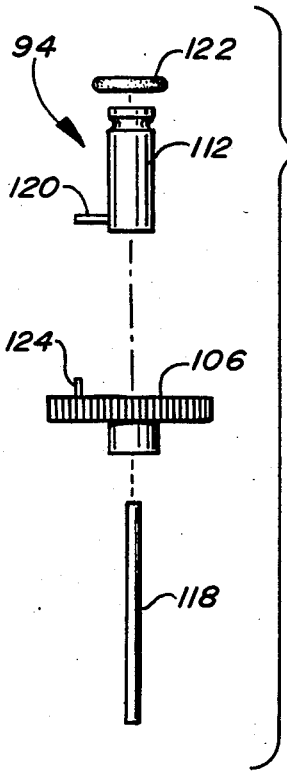
FIG. 6 is an exploded detail of the first roller of the injector of FIG. 5 incorporating a finger clutch.

To allow time for carousel 48 to rotate the next empty slot into position before the next card is inserted, third roller 98 turns faster than first and second rollers 94 and 96. To prevent binding while both the first and third rollers 94 and 98 are engaged on card 93, first roller 94 is equipped with a finger clutch, seen in FIG. 6. First roller 94 has a wheel 122 on a shaft 112 with a gear 106. Gear 106 and shaft 112 are not fixed together.

A pin 118 goes through the center of gear 106 and shaft 112 and allows roller 94 to turn on its support 54.

When a card 93 engages only first roller 94, gear 106 turns causing finger 124 to engage finger 120. Gear 106 and shaft 112 with wheel 122 then turn in unison, driving card 93 toward carousel 48. When card 93 engages both first and third rollers 94 and 98, card 93 is driven by third roller 98 at increased speed into carousel 48. Shaft 112 is forced to turn faster than gear 106 causing the fingers to disengage. Shaft 112 then turns independently from gear 106 for nearly one rotation, accommodating the period of dual engagement. When the card disengages roller 94, shaft 112 stops until gear 106 rotates to engage fingers 120 and 124 again. This introduces an additional delay further separating the cards.

A sensor or scanner 104 is disposed for reading identification-markings on a card 93 being loaded from hopper 22 into carousel 48. Scanner 104 is a first transducer means which is preferably an optical scanner that reads bar codes printed or attached in strips onto the cards. The injector rollers are generally slightly tilted relative to the card path so that the roller drives the card so that it is lined up with the scanner. The bar code is preferably on the face side of the card. It is parallel to and along both of the longer edges so that reading is possible in two orientations. Distinguishing details of ordinary playing cards may also be read if enough optical scanners are used. Alternatively, scanner 104 may be a magnetic or other type of scanner that can sense identification data on the cards. Scanner 104 may also read an instruction card with a bar code or other type of data containing program parameters for a specific game. Scanner 104 is in communication with control board 52, containing a microprocessor which is able to keep track of which slots contain cards and which cards are in which slots.

With reference again to FIGS. 3 and 4, carousel 48 consists of a flat base plate 78 with many dividers 80 protruding up from carousel base 78 to create slots 82 for individual cards. Typically, the dividers 80 are about half as high as standard playing cards are wide, i.e. about $1\frac{1}{4}$ inches (3 cm) high, and protrude into the center of carousel 48 toward hub 58 about one third of the way. This allows each card maximum freedom in its slot 82 in order to prevent jamming. Several of the dividers 80 extend all of the way to hub 58 to keep cards from sliding around the hub. Hub 58 is free to rotate on hub pin 56, which is mounted to or part of molded base 14.

Carousel 48 is driven by a small motor 84 with a cogged pulley 85 powered by batteries. A cogged belt 6 wraps around pulley 85 and a pulley 88. Typically, the diameter of pulley 88 is about four to ten times larger than the diameter of pulley 85. A second pulley 89 is fixed coaxially to and rotates with pulley 88. A cogged drive belt 90 wraps around second pulley 89 and a carousel pulley 92 coaxially fixed to carousel base 78. Typically, the diameter of carousel pulley 92 is about four to ten times larger than the diameter of second pulley 89. Thus, 16 to 1000 rotations of pulley 85 turns carousel 48 once around. Motor 84 is capable of turning at over 5000 rpm and is thus capable of turning the carousel at an angular velocity of 5 to 312 rpm, depending on the relationship of the pulleys.

Motor 84 positions carousel 48 accurately to within a fraction of a degree. This is typically accomplished with a closed loop servo controller, which generally employs an optical encoder wheel attached to pulley 85. Optical emitters and detectors 91 are positioned in relation to the encoder wheel such that light from the emitters is interrupted by the rotating wheel and detected to provide position feedback. The motor 84 is preferably driven in a proportional manner using pulse-width modulation. Polarity and pulse-width modulated voltage to the motor are commanded by control board 52 and derived from current position, desired position, previous position and external factors, such as varying moment of inertia due to the presence or absence of cards. Preferably, the well known method of a digital proportional-integral-derivative control law is used. Alternatively, other methods of feedback and motor control may be used to turn and position the carousel so that cards are injected or ejected in a fast and efficient manner.

In FIGS. 3 and 4, ejectors 50 are positioned around carousel 48, one beside each output port 30. Each ejector 50 sits on a rocker 136 which is supported on pivots 130 and 132 above molded base 14. When motor 134 is turned on, the ejector 50 pivots, lifting roller 128 into position between dividers 80 for driving a card from slot 82 into output port 30. The angle of roller 128 against the card is generally selected to make the roller 128 self-energizing, drawing it into firm contact with a card. Typically, the axis of roller 128 is about 45 degrees from vertical and the ejector 50 is aligned 20 degrees off from the radial direction. However, these angles may vary.

Figure 7:
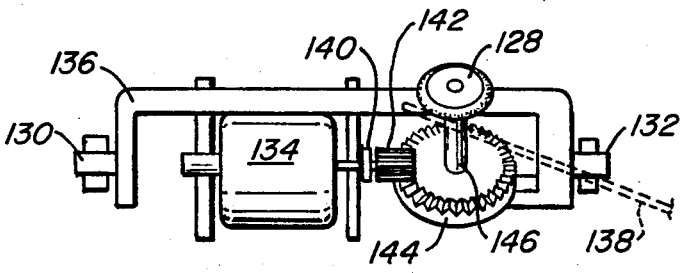
FIG. 7 is a top view of the ejector mechanism used in the apparatus of FIG. 1.
Figure 8:
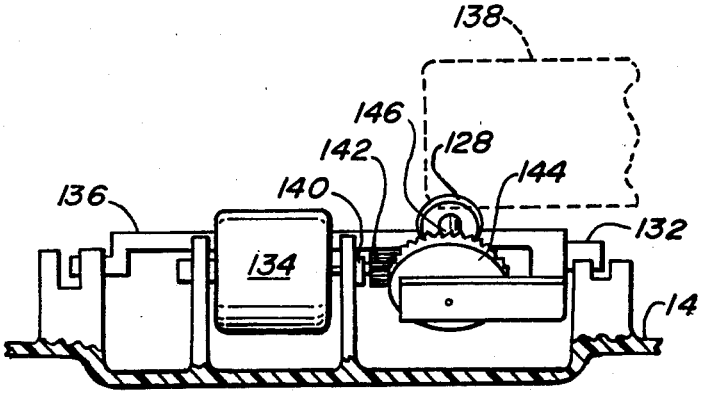
FIG. 8 is a side view of the ejector.

Ejector 50, seen in FIGS. 7 and 8 in greater detail, has an ejector motor 134 seated on a rocker 136. Rocker 136 is pivotally supported on pivots 130 and 132 above molded base 14. A centripetal clutch 140 is connected to motor 134. A pinion 142 protruding through centripetal clutch 140 meshes with a crown gear 144. Crown gear 144 is rotatably mounted on its axis to rocker 136. Roller 128 is fixed to the tip of an extension of crown gear 144. Shaft 146 is fixed on the end opposite roller 128 to the rocker 136.

In operation, when motor 134 is turned on, centripetal clutch 140 exerts a torque on the ejector causing rocker 136 to pivot on pivots 130 and 132. This brings roller 128 into place against card 138. Pinion 142 turns crown gear 144 which causes roller 128 to turn, driving the card out of the carousel. When motor 134 is turned off, centripetal clutch 140 disengages and gravity pulls roller 128 down and away from the slot.

An alternative method for ejecting cards involves the separate actions of first lifting the card and then driving the card. From below, a lifter mechanism lifts the end of one card up and slightly out of the carousel. A pair of angled rollers turning above the slot then grab the edge of the card and eject the card radially from the carousel. The lifters for all user stations may be actuated by a common motor. In this case individual motors turn only those rollers at user stations where an ejection should occur. Or all the rollers could be driven with a common motor. In this case a separate motor or solenoid is used at each user station to lift only those cards to be ejected. The lifting may also be performed by activating a spiral ramp engaging the lifter. The spiral ramp turns on the shaft of the motor which drives the roller for that user station. After ejection the motor is reversed bringing the lifter back down. Alternatively, a single ejector mechanism of any of the types above may be mounted coaxially with the carousel. This assembly is then rotated to the user station where an ejection is needed.

The card game apparatus 10 is controlled by the control board 52, containing a microprocessor. The microprocessor communicates with sensor 91, scanner 104, the selectors 74 and the control panel 38 to keep track of carousel position, the identity of cards in each slot, card selections, and the like, and commands the various motors to inject cards, turn the carousel, and eject cards.

Control board 52 is also in communication with sensors for commanding the carousel to perform as a sensing means. The carousel may be driven by a stepping mechanism, a stepper motor or a servo motor. The latter choice allows the carousel, under control of the microprocessor, to be used as a sensing means. If a card is made to interfere with the carousel, the carousel's failure to rotate is sensed and the microprocessor may then initiate corrective measures. A protrusion of the carousel can be made to interfere with a lifted ejector and thus the carousel's initialization position may be inferred by the microprocessor. Using the carousel as a sensing means can also enable the microprocessor to calibrate the location of each of the ejectors and the injector. This sensing means can also be used by the microprocessor to determine the amount of current needed to lift the ejectors.

Figures 9, 9A:
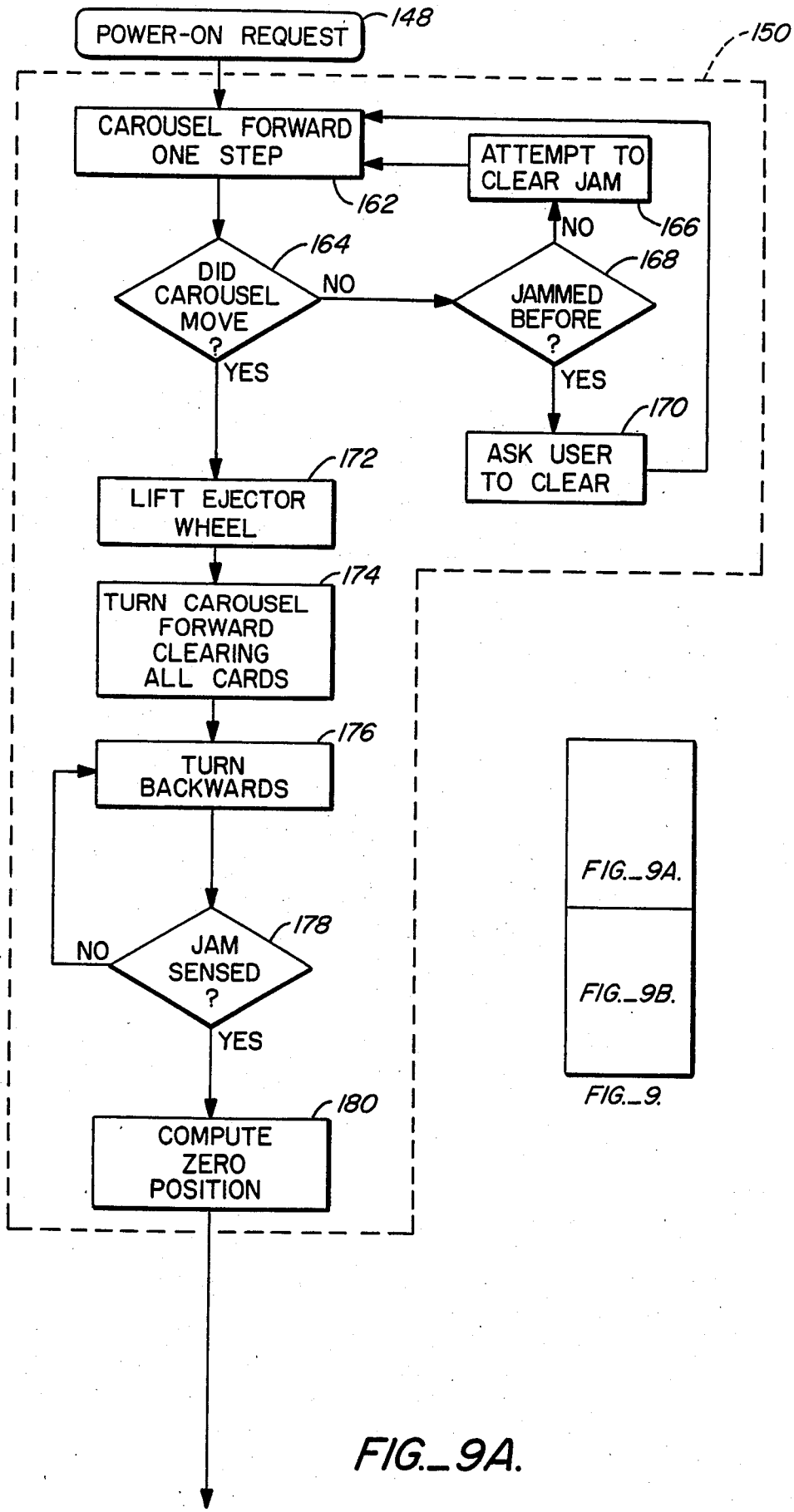
FIG. 9 is a plan showing the relationship between FIGS. 9*a* and 9*b*.
FIG. 9*a* is the top half of a flow chart of the operation of the apparatus of the present invention.
Figure 9B:
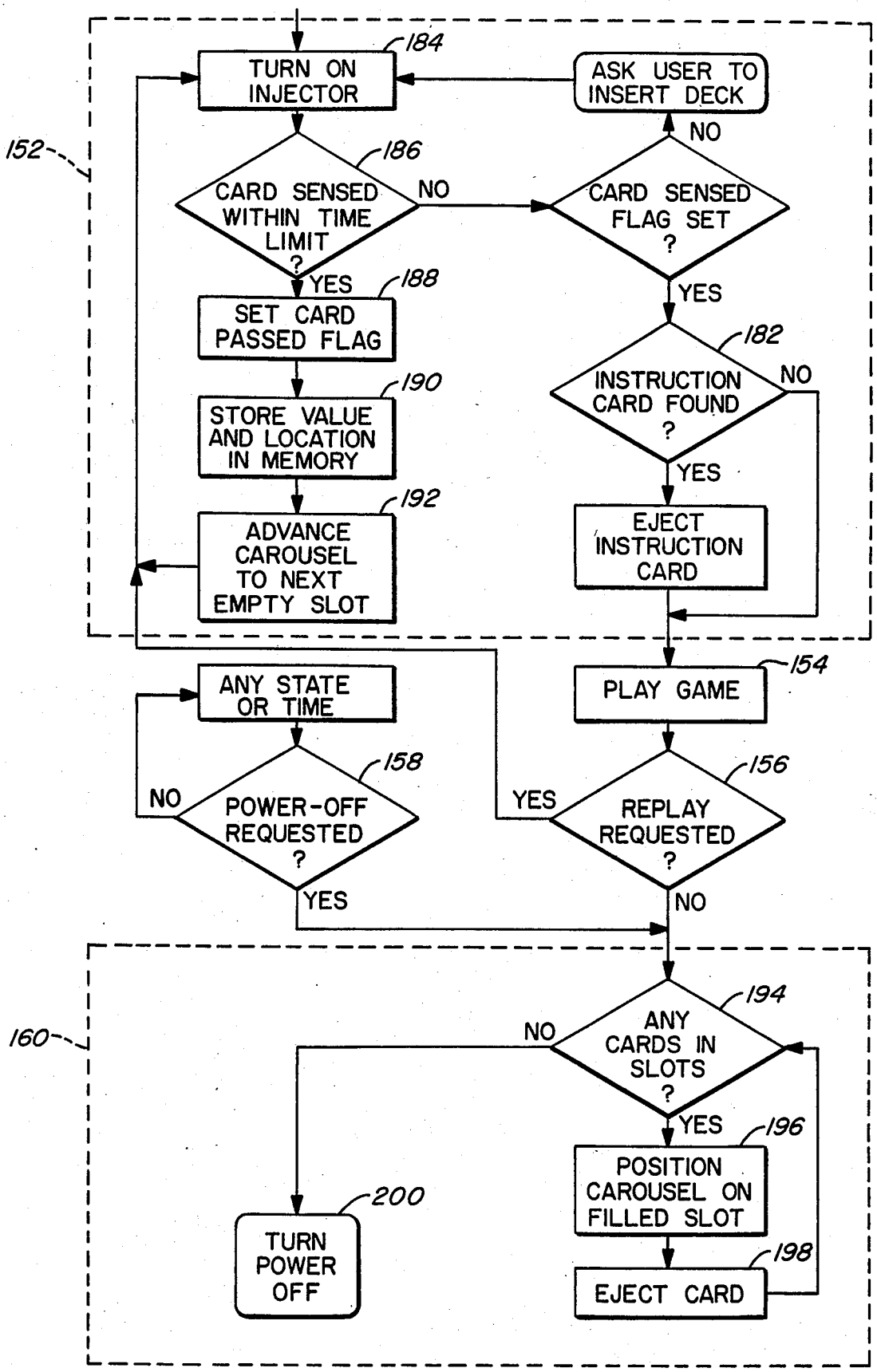
FIG. 9*b* is the bottom half of the flow chart of the operation of the apparatus of the present invention.

A control panel of buttons and indicators 38 is used to command and communicate a variety of functions such as 148, 170 and 152. With reference to FIG. 9, when the power is turned on, indicated by block 148, the game apparatus is initialized 150, then the user inserts cards 93 into the hopper 22 which are then loaded into carousel 48 by injector 46, as indicated by block 152. The game or activity is played, as indicated by block 154 and replayed, as indicated by block 156 one or more times. Cards are loaded 152 each time the game or activity is replayed. When play or activity is finished or any time power-off is requested, as indicated by block 158, the apparatus goes through a power-off sequence 160.

When the power is turned on 148, the mechanism is first initialized in three steps, as indicated by block 150. First, the carousel must be made free to turn. This will not be the case if a card is partially injected or ejected. The carousel is commanded to turn forward on step 162. If this command does not result in the expected motion 164, then a jam is inferred. In this case, each of the ejectors and the injector is turned on briefly in an attempt to clear the jam, as indicated by block 166. If the jam persists 168, the user is prompted to fix the problem manually 170. Second, when the carousel is free to turn, cards are cleared from the carousel. One or more ejectors are lifted into place, as indicated by block 172 and the carousel is systematically rotated slowly forward, as indicated by block 174. This results in the ejection of any cards that may be in the carousel. Third, an ejector 50 is raised and the carousel turns backward 176. One of the slots has a protrusion into which the center of the ejector roller runs causing a jam to be sensed 178. This establishes the zero position 180.

The user inserts cards into the hopper. After the apparatus is initialized 150, cards are loaded 152. The deck may also include an instruction card. This special card has the title and instructions for the game listed on it. Also specified in bar code or other identification markings, are program instructions for the control board. If no game selection card is entered, the apparatus is directed via control panel buttons as indicated by block 182. A user presses a control panel button, which turns on the injector motor bringing the first card past the sensor. If identification markings are detected, then the position of each card is stored in memory 190. Otherwise, the sensor is used only to signal the passage of card 186. In either case, the cards are counted and the slots used are registered 190. When one card is injected, the carousel quickly positions itself for the next card 192. This continues, as indicated by block 186, until all the cards are removed from the hopper.

The game or activity is played, as indicated by block 154, according to the instructions on the instruction card or via the control panel buttons. To play again 156, cards used are reentered into the hopper and reloaded 152 in preparation for the next game or activity.

Whenever power-off is requested, the apparatus goes into a power-off sequence 160. If any cards are still in the carousel 194, the carousel is rotated to the filled slot 196 and the card is ejected 198. This continues until the carousel is empty. Power is then turned off as indicated by block 200.

The apparatus is capable of playing many card games. In addition to being able to play standard card games, the instruction cards allow the apparatus to be used with any future game without having an elaborate user display and keyboard. This also allows the enthusiast to design his or her own games redefining the game operation and function of the control panel buttons by marking blank instruction cards.

I claim:

1. A method for playing a card game comprising, selecting any desired cards of particular identities in a deck of cards by each of a plurality of players, each of said players selecting the identity of at least one card, delivering a card from an apparatus holding the deck, said cards having identification markings thereon, said apparatus capable of reading said markings and delivering the cards to each of said players, some of said cards being null cards having no value in determining an outcome of a card game, said selecting step and said card delivering step defining a round, said null cards being delivered to players selecting identical cards during the same round, and being delivered to players selecting a card delivered to a player in any previous round, said desired cards otherwise being delivered when selected by said players, repeating said selection step and said card delivering step until a predetermined number of cards are delivered to each player, each repetition of said selection step and said card delivering step defining a different round, and determining the outcome of said card game.

2. The method of claim 1 wherein said selecting step has a time limit, any player failing to select a card within said time limit receiving one of said null cards.

3. The method of claim 1 wherein said delivering of a card is carried out by a card game apparatus which stores cards at locations therein and which delivers cards to each of said players, said apparatus capable of reading said machine readable indicia on said cards and remembering the locations of said cards stored therein.

4. The method of claim 3 wherein said selecting of cards is accomplished by each player selecting a card by electrically signalling to said card game apparatus.

5. A method of playing a card game comprising, (a) electronically reading and mechanically storing a deck of cards identification-marked with machine readable indicia, (b) locating said cars by machine, electronically reading the identities of said located cards and delivering some of said located cards from the deck to a plurality of players, (c) selecting any specific desired cards from the same said deck by each player, (d) delivering a card from the deck to each of said players, the identities of said delivered cards corresponding to cards selected in step (c), steps (c) and (d) defining a round, (e) repeating steps (c) and (d) until a determined number of cards is delivered to each player, each repetition of steps (c) and (d) defining a different round, and (f) determining an outcome of the card game.

6. The method of claim 5 wherein some of said cards are null cards having no value in determining said outcome.

7. The method of claim 6 wherein any player selecting an identical card selected by another player in the same round each receiving one of said null cards, any player selecting a card delivered to a player in any previous round receiving one of said null cards and any players otherwise receiving cards selected by them.

8. The method of claim 7 wherein said selecting step has a time limit, any player failing to select a card within said time limit receiving one of said null cards.

9. The method of claim 5 wherein any player selecting an identical card to a card selected by another player in the same round each receiving a randomly chosen card, any player selecting a card delivered to a player in any previous round receiving a randomly chosen card, and any players otherwise receiving a randomly chosen card, and any players otherwise receiving cards selected by them.

10. The method of claim 5 wherein the outcome of said game is determined by rules of poker.

* * * * *